United States Patent [19]

Haag

[11] 4,050,649

[45] Sept. 27, 1977

[54] CREELING DEVICE FOR BOBBINS

[75] Inventor: Walter Haag, Weil der Stadt, Germany

[73] Assignee: Albert Haag KG, Weil der Stadt, Germany

[21] Appl. No.: 686,950

[22] Filed: May 17, 1976

[30] Foreign Application Priority Data

May 17, 1975 Germany ..... 7515903[U]

[51] Int. Cl.[2] ..... B65H 49/02; D03J 5/08

[52] U.S. Cl. ..... 242/130.1; 242/68

[58] Field of Search ..... 242/46–46.3, 242/130.1, 68–68.5, 134; 269/48, 48.1, 52; 81/71; 279/1 Q, 1 R, 1 A; 248/309 A; 403/367–369

[56] References Cited

U.S. PATENT DOCUMENTS

| | | | |
|---|---|---|---|
| 1,934,169 | 11/1933 | Crooks | 242/130 |
| 2,529,351 | 11/1950 | Putnam | 242/130.1 |
| 3,620,465 | 11/1971 | Wyatt et al. | 242/55.2 |

FOREIGN PATENT DOCUMENTS

| | | | |
|---|---|---|---|
| 1,133,509 | 3/1957 | France | 242/130.1 |
| 707,133 | 6/1941 | Germany | 242/68.4 |

*Primary Examiner*—Leonard D. Christian
*Attorney, Agent, or Firm*—Walter Becker

[57] ABSTRACT

A creeling device for bobbins, especially for bobbins with conical sleeves, which includes a clamping member with resilient ribs and with a limited spring stroke of the resilient ribs. Preferably the creeling device comprises a central or hub portion surrounded by an annular resilient portion radially spaced from the hub portion and provided with ribs extending in the axial direction of the annular resilient portion which latter has one end resiliently connected to the hub.

5 Claims, 6 Drawing Figures

CREELING DEVICE FOR BOBBINS

The present invention relates to a creeling device which comprises a spindle having arranged thereon at the front end a clamping member and therebehind a centering member. The clamping member is non-displaceably arranged on the spindle whereas the centering member is as a rule displaceably mounted on the spindle. The centering member must be displaceable if the same creeling device is to be employed for different sleeves with a different conical angle.

It is, therefore, an object of the present invention to provide a creeling device of the above mentioned general character with a new improved clamping member. This object and other objects and advantages will appear more clearly from the following specification in connection with the accompanying drawings, in which.

Figure 1:
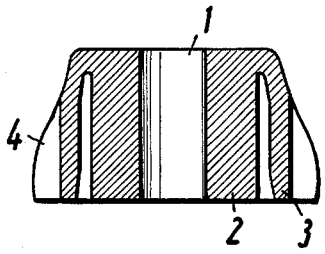
FIG. 1 illustrates a transverse section through a clamping member according to the present invention.
Figure 3:
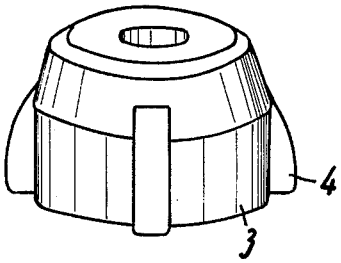

FIG. 3 shos a perspective view of the clamping member according to FIg. 1.

Figure 2:
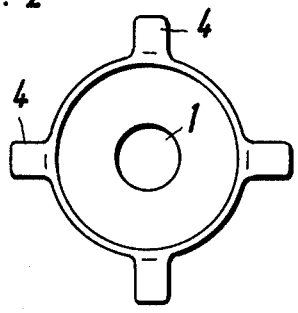
FIG. 2 is a bottom view of FIG. 1.
Figure 4:
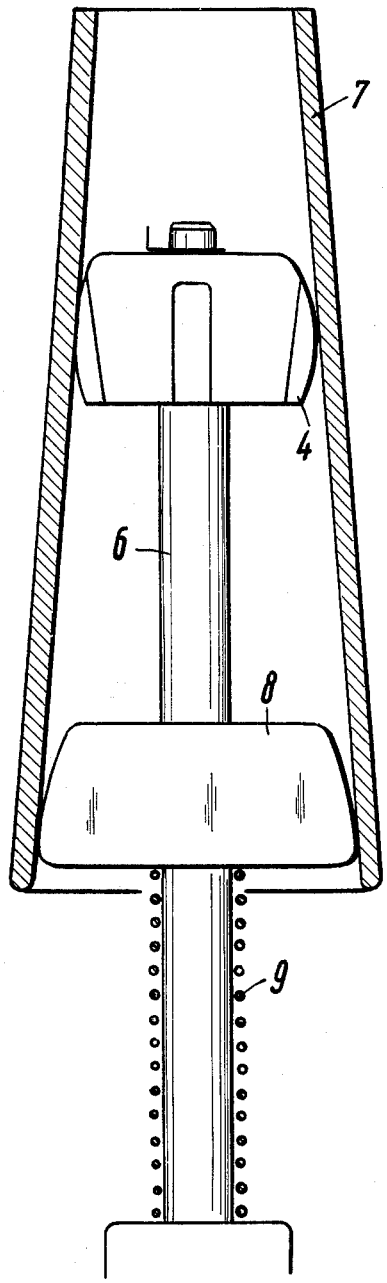

FIG. 4 shows the complete creeling device with the clamping member of FIGS. 1 to 3, partly in section and partly in view.

Figure 5:
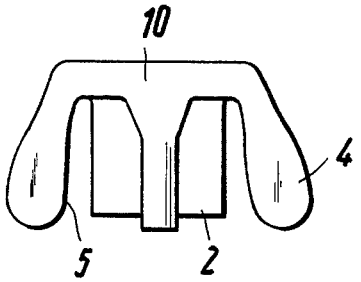

FIG. 5 is an elevational view of a second embodiment of the clamping member according to the invention.

Figure 6:
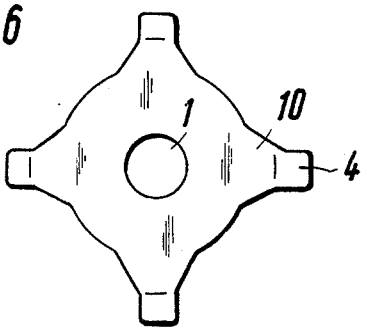

FIG. 6 represents a bottom view of FIG. 5.

The clamping member according to the present invention has resilient ribs or fins on which the sleeve rests on a cylinder slightly spaced from the hub of the clamping member. The limitation of the spring stroke of the ribs in one direction is brought about by the engagement of the hub with the above mentioned cylinder.

According to a second design of the clamping member according to the invention, the cylinder is omitted. The resilient ribs are arranged directly at the front end of the hub of the clamping member. With this design, the limitation of the spring stroke of the ribs is effected by the ribs engaging the hub of the clamping member.

The creeling device according to the present invention for bobbins, especially for bobbins with conical sleeves is characterized primarily by a clamping member with resilient ribs and by a limitation of the spring stroke of the ribs.

Referring now to the drawings in detail, the clamping member generally designated 1 has a bore 1*a* for receiving the spindle 6 (see FIG. 4) and also has a hub or central section 2. The clamping member 1 is provided with a cylinder or an undivided annular member 3 having peripheral resilient ribs 4 (see FIGS. 2 and 3) which are adapted to spring until the back side 5 of said ribs contact the hub or central section 2. The limitation of the radially inwardly resilient stroke of the ribs by the hub or central section 2 has the advantage that no permanent expansion can occur. It furthermore has the advantage that when creeling, the bobbin operator can feel when a certain fixed seat for the bobbins has been obtained. In the area where the ribs engage the sleeve, the ribs are so rounded that also perforated sleeves can easily be withdrawn from the creeling device.

FIG. 4 shows the complete creeling device. As will be seen therefrom, the clamping member 1 is fastened to the front end of the spindle 6 while the sleeve 7 rests on the ribs 4 of the clamping member 1. Below the clamping member 1 there is provided a centering member 8 which is displaceably arranged on spindle 6 and which for instance by means of a weak spring 9, after withdrawal of the empty sleeve 7 is slightly pressed against the clamping member.

The creeling device may be employed with sleeves of different conical angles. With a small conical angle, the distance between the centering member 8 and the clamping member 1 is greater than is the case with a greater conical angle of the sleeve. In other words, the distance between the centering member and the clamping member changes in a reverse manner to the change in the conical angle.

Referring now to the second embodiment of the clamping member as illustrated in FIGS. 5 and 6, the resilient ribs 4 are at the front connected to the hub and after being compressed cause their rear side 5 of the ribs 4 directly to engage the hub 2. The front of the ribs is provided with a widened section 10. Also with this embodiment, the ribs 4 are within the region of their engagement with the sleeve provided with a rounded portion so that the clamping member for the sleeves can be employed with different conical angles and that also an easy withdrawal of perforated or inwardly ribbed sleeves will be assured. The clamping member according to the invention consists of an elastic synthetic material preferably of an elastomeric synthetic material.

It is, of course, to be understood that the present invention is, by no means, limited to the specific showing in the drawing but also comprises any modifications within the scope of the appended claims.

What I claim is:

1. A creeling device for textile bobbins, especially for bobbins with conical sleeves, having an interior of differing tapering angle, consisting of a spindle upon which a clamping member of elastomeric synthetic material positively frictionally engaging the interior is arranged having a central section with an outer circumference as well as an axis and resilient ribs distributed outwardly away from though extending axially of the outer circumference of said central section in radially spaced relationshup thereto, said central section including means for limiting the radially inward movement of said ribs resiliently toward the axis of said central section.

2. A device according to claim 1, which includes an undivided annular member substantially concentrically surrounding said central section in radially spaced relationship thereto and carrying said ribs, said annular member having only one of its ends resiliently connected to said central section.

3. A device according to claim 2, in which the means for limiting the radially inward movement of said ribs are formed by a portion of said central section acting as abutment for said ribs and located at that end portion of said annular member which is remote from that one end of said annular member which is resiliently connected to said central section.

4. A device according to claim 1, in which said ribs are connected at one end only to said central section while leaving a gap that remains between said central section and said ribs in conformity with the intended maximum stroke of said ribs in radial direction toward the axis of said central section.

5. A device according to claim 4, in which the width of said ribs increases arcuately in the direction away from the connection of said ribs with said central section.

* * * * *